US007901512B2

(12) United States Patent
Quinter et al.

(10) Patent No.: US 7,901,512 B2
(45) Date of Patent: Mar. 8, 2011

(54) FLAVORED SMOKELESS TOBACCO AND METHODS OF MAKING

(75) Inventors: Phillip F. Quinter, Hermitage, TN (US); Frank Atchley, Nashville, TN (US)

(73) Assignee: U.S. Smokeless Tobacco Company, Richmond, VA (US)

( * ) Notice: Subject to any disclaimer, the term of this patent is extended or adjusted under 35 U.S.C. 154(b) by 407 days.

(21) Appl. No.: 10/979,266

(22) Filed: Nov. 2, 2004

(65) Prior Publication Data

US 2005/0115580 A1 Jun. 2, 2005

Related U.S. Application Data

(60) Provisional application No. 60/516,912, filed on Nov. 3, 2003.

(51) Int. Cl.
*A24B 15/30* (2006.01)

(52) U.S. Cl. ..... 131/275; 131/276

(58) Field of Classification Search ..... 131/273–276
See application file for complete search history.

(56) References Cited

U.S. PATENT DOCUMENTS

| | | | | |
|---|---|---|---|---|
| 3,934,594 | A | 1/1976 | Beringer et al. | |
| 3,943,943 | A | 3/1976 | Cartwright et al. | |
| 3,944,679 | A | 3/1976 | Takahara et al. | |
| 4,052,993 | A | 10/1977 | Cartwright et al. | |
| 4,069,828 | A | 1/1978 | Hall et al. | |
| 4,135,520 | A | 1/1979 | Light et al. | |
| 4,170,236 | A | 10/1979 | Withycombe et al. | |
| 4,207,905 | A | 6/1980 | Withycombe et al. | |
| 4,253,473 | A | 3/1981 | Marmo et al. | |
| 4,528,993 | A | 7/1985 | Sensabaugh, Jr. et al. | |
| 4,533,746 | A | 8/1985 | Wilson et al. | |
| 4,606,357 | A | 8/1986 | Dusek et al. | |
| 4,624,269 | A | 11/1986 | Story et al. | |
| 4,832,059 | A | 5/1989 | Garrard et al. | |
| 5,092,352 | A | 3/1992 | Sprinkle, III et al. | |
| D335,934 | S | 5/1993 | Howard | |
| 5,518,743 | A | 5/1996 | Pergola et al. | |
| 5,525,351 | A | 6/1996 | Dam | |
| 5,845,647 | A | 12/1998 | O'Donnell, Jr. et al. | |
| 5,944,026 | A | 8/1999 | Kopsch et al. | |
| 6,004,593 | A | 12/1999 | Soughan | |
| 6,053,175 | A * | 4/2000 | D'Angelo | 131/300 |
| 6,397,852 | B1 | 6/2002 | McAdam | |
| 2002/0162563 | A1 | 11/2002 | Williams | |
| 2002/0170567 | A1 | 11/2002 | Rizzotto et al. | |
| 2003/0094182 | A1 | 5/2003 | Atchley et al. | |
| 2006/0185686 | A1 * | 8/2006 | Lawrence | 131/352 |

FOREIGN PATENT DOCUMENTS

EP 0 140 670 5/1985

OTHER PUBLICATIONS

Determination of L and D-amino acids in smokeless tobacco, Nov. 2005,pp. 1-5.*
Snuff Production, May 2009, pp. 1-2.*
Betel-Quid and Areca-Nut Chewing, 1985, International Agency for Research on Cancer (IARC) Monographs, 85:41-278.
Smokeless Tobacco Fact Sheets, 3rd International Conference on Smokeless Tobacco, Stockholm, Sweden, Sep. 22-25, 2002.
Brown & Williamson Tobacco Corporation Research & Development Internal Correspondence, dated Oct. 6, 1992, Bates # 575100128 through 575100131.
Hanners, "ASH on New Secret memo Helping FDA," http://www.no-smoking.org/may99/05-24-99-2.html, dated May 23, 1999 5 pages.
Brown & Williamson Tobacco Corporation Internal Correspondence, dated Dec. 20, 1984, Bates # 509000972 through 509000980, 620396343, 12 pages.
Brown & Williamson Tobacco Corporation Research, Development & Engineering Meeting Report, dated Apr. 24, 1986, Bates # 620396341 through 620396342.
Brown & Williamson Tobacco Corporation Research & Development Internal Correspondence, dated May 15, 1995, Bates # 397100104 through 397100107, 6 pages.
RJ Reynolds Brainstorming Ideas—Scientist Group, dated Jan. 27, 1993; Bates # 51293 4749 through 51293 4753, 5 pages.
American Tobacco, The Vaporette Inhaler System, Loaded to tobaccodocuments.org on Nov. 23, 1998, 7 pages.
Philip Morris Brainstorming Session, dated Aug. 21, 1990, Bates # 2020256092-2020256094.
Hasenfratz et al., Nicotine Absorption Subjective and Physiologic Effects of Nicotine Toothpicks, *Clin. Pharmocol. Ther.*, 1991, 50: 456-461, Bates # 2050803545 through 2050803550.

* cited by examiner

*Primary Examiner* — Carlos Lopez
(74) *Attorney, Agent, or Firm* — Fish & Richardson P.C.

(57) ABSTRACT

The invention provides a method of imparting flavor to smokeless tobacco, and the flavored smokeless tobacco produced therefrom.

28 Claims, No Drawings

FLAVORED SMOKELESS TOBACCO AND METHODS OF MAKING

CROSS REFERENCE TO RELATED APPLICATIONS

This application claims priority under 35 U.S.C. §119(e) of U.S. application Ser. No. 60/516,912, filed Nov. 3, 2003.

TECHNICAL FIELD

This invention relates to smokeless tobacco products, and more particularly to flavored smokeless tobacco and methods of making such flavored smokeless tobacco.

BACKGROUND

Smokeless tobaccos are products that are consumed without subjecting the product to combustion. These products are manufactured in a variety of forms including chewing tobacco, dry snuff, and moist snuff. Generally, these types of products are made as follows with the steps being in no particular order: cutting or grinding the tobacco into a suitable size; dipping or spraying the tobacco with a casing solution; partially drying the tobacco; holding the tobacco in containers for a period of time; and packaging it.

Chewing tobacco is typically sold in one of three forms: a "plug" where the tobacco is compressed into one of any number of shapes: "twists," where leaves are entwined into a rope-shaped product; and loose, leafy chewing tobacco where it is presented in an envelope-like container. Plugs typically have a moisture content around 15% or less by volume for "hard" plugs and greater than 15% for "soft" plugs. Twists and loose, leafy material are typically lower in moisture.

Snuffs typically are marketed as either "dry" or "moist." Dry snuffs have moisture content around 8%. Moist snuffs, which typically have about 40 to 60% moisture content, can have a variety of particle sizes depending on the product.

SUMMARY

The invention provides methods of imparting flavors to smokeless tobacco. The invention also provides a flavored smokeless tobacco produced using the methods of the invention.

In one aspect, the invention provides methods of imparting flavors to smokeless tobacco. Such methods include combining tobacco with one or more solid flavor agents to form a flavored smokeless tobacco having a flavor characteristic of the solid flavor agents.

In another aspect, the invention provides a flavored smokeless tobacco composition that includes the smokeless tobacco and one or more solid flavor agents.

In yet another aspect, the invention provides a flavored smokeless tobacco composition produced by combining the smokeless tobacco and one or more solid flavor agents.

In still another aspect, the invention provides methods of making a flavored smokeless tobacco composition. Such methods include providing smokeless tobacco; and combining the smokeless tobacco with one or more solid flavor agents to form the flavored smokeless tobacco composition.

Generally, the solid flavor agents comprise about 1% to about 30% by weight. Representative solid flavor agents include beans, nuts, sticks, and/or the like. In one embodiment, the beans, nuts, and/or sticks are whole beans, nuts, and/or sticks. In another embodiment, the beans, nuts, and/or sticks are ground beans, nuts, and/or sticks. Representative beans include coffee beans, vanilla beans, cocoa nibs, and/or the like. Representative nuts include but are not limited to almonds, peanuts, cashews, walnuts, pecans, and pistachios.

Coffee beans used in the invention can be whole or ground, roasted or not, and can be natural or decaffeinated. In certain embodiments, the coffee beans can be Arabica, Brazillian Santos, Columbian Supremo, Costa Rican, Ethiopian Harrar, Hawaiian Kona, Kenya AA, Jamaica, Sumatra, Tanzanian Peaberry, or Zimbabwe coffee beans. Such coffee beans can additionally include one or more flavors that can be found with currently available specialty coffees. Such flavors can include hazelnut, vanilla, ameretto, fruit flavors, almond, Irish cream, cinnamon, butterscotch, and/or the like.

In an embodiment, the moisture content of the smokeless tobacco can be from about 25% to about 60%. Typically, the pH of smokeless tobacco products is approximately 7 to 8. In yet another embodiment, the salt concentration of the smokeless tobacco is typically between about 1% and about 10%.

Typically, the flavored smokeless tobacco is moist snuff or chewing tobacco. The tobacco used in the methods and compositions of the invention can be burley, dark air-cured, dark-fired, flue cured, oriental, cigar filler or wrapper, and any other tobacco including rare and specialty tobaccos. Additionally, the tobacco can be fermented or unfermented. In certain embodiments, the solid flavor agent can be separated from the smokeless tobacco after the flavored smokeless tobacco is formed.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In addition, the materials, methods, and examples are illustrative only and not intended to be limiting. All publications, patent applications, patents, and other references mentioned herein are incorporated by reference in their entirety. In case of conflict, the present specification, including definitions, will control.

The details of one or more embodiments of the invention are set forth in the accompanying drawings and the description below. Other features, objects, and advantages of the invention will be apparent from the drawings and detailed description, and from the claims.

DETAILED DESCRIPTION

Tobacco

As used herein, "tobacco" refers to any part, e.g., leaves or lamina and stems, of burley, dark air-cured, dark-fired, flue cured, oriental, cigar filler or wrapper, and rare and/or specialty tobaccos. Tobacco suitable for use in the invention can be whole leaves or stems, or the tobacco may be shredded, cut, or otherwise processed. Tobacco useful in the invention may be in the form of a finished smokeless tobacco product, including but not limited to, moist snuff, dry snuff, or chewing tobacco. For example, tobacco suitable for use in the invention can be fermented or unfermented tobaccos, cured (e.g., air cured), burley, dark, dark-fired, flue cured, oriental, and cigar filler or wrapper. The tobacco used in the invention can be mixed with other additives or flavors as known in the smokeless tobacco art. Hence, the percentages used herein with respect to tobacco may be with respect to tobacco alone or to tobacco in combination with various known additives.

Chewing tobacco and snuffs are often treated with any of a number of flavors to diminish some of the less desirable taste characteristics sometimes associated with the tobacco. The addition of flavors requires solvent systems for spraying, which are generally added during the preparation process of tobacco products. The method of spraying can be costly and the flavor can sometimes deteriorate during product preparation and upon storage. Further, this method has not been very successful in transferring certain flavors to smokeless tobacco. The invention therefore provides a novel method to impart flavors into a smokeless tobacco product without the traditional flavor application systems.

Production of Flavored Smokeless Tobacco

After choosing an appropriate tobacco type, the tobacco can be chopped or ground to an appropriate size depending on the type of smokeless tobacco product being made. The material can be further separated based on size by passing the cut tobacco over a screen for sizing. The methods of chopping or grinding of the tobacco may be accomplished using the methods known in the art for that purpose.

As described herein, the moisture content, the pH, and the salt concentration of tobacco is critical in preparing palatable flavored smokeless tobacco. Moisture content, pH, and salt concentration of tobacco can be measured using methods known to those of skill in the art. Tobacco suitable for use in the invention typically has a moisture content of between 25% and 60%, e.g., at least 25%, 30%, 35%, 40%, 45%, 50%, 55%, or 60%; a pH of between 7.0 and 8.5, e.g., at least 7, or 8; and a salt concentration of between 1% and 10%, e.g., at least 1%, 2%, 3%, 4%, 5%, 6%, 7%, 8%, 9%, or 10%.

The invention provides for a flavored smokeless tobacco. A flavored smokeless tobacco refers to any smokeless tobacco that has been imparted with a flavor from a solid flavor agent. As used herein with respect to flavors, the term "impart" means to transfer or convey the desired flavor characteristic or note from one or more solid flavor agents to the tobacco.

A solid flavor agent refers to any type of solid substrate (e.g., beans, nibs, nuts, and sticks) having the ability to impart a flavor. Representative flavor beans include, but are not limited to, coffee beans, vanilla beans, and cocoa nibs. Representative flavor nuts include, but are not limited to, almonds, peanuts, cashews, walnuts, pecans, and pistachios. Solid flavor agents for use in the invention can be whole beans, nuts, or sticks. Alternatively, solid flavor agents such as beans, nuts, or sticks can be ground using known methods. Generally, the amount of a solid flavor agent present in a flavored smokeless tobacco composition is from about 1% to about 30% by weight.

The mixture of tobacco and flavor beans or nuts is combined by any number of methods known in the art including mixing, stirring, rotating, vibration, shaking, and the like. The mixture is stored for a period of at least 2 days (e.g., at least 7 days, at least 10 days, at least 2 weeks) prior to use, which may vary depending upon the temperature and the solid flavor agent used. While the transference of flavor can be detected in about 2 days, leaving the mixture for longer periods of time allows for greater levels of flavor to develop. The solid flavor agent can be removed from the tobacco by conventional separation techniques or can remain in the final product. Separation techniques include a variety of methods known in the art such as sifting based on particle size.

Flavor beans or nuts may differ in taste and/or flavor depending upon the variety of bean or nut and the environment in which the bean or nut is grown. For example, there are numerous types of coffee beans with distinctive flavors, including Arabica, Brazillian Santos, Columbian Supremo, Costa Rican, Ethiopian Harrar, Hawaiian Kona, Kenya AA, Jamaica, Sumatra, Tanzanian Peaberry, and Zimbabwe. In addition, coffee beans used as a solid flavor agent of the invention can be roasted or not, and can be natural or decaffeinated.

A flavored smokeless tobacco of the invention may possess one or more flavoring components in addition to a solid flavor agent. For example, coffee beans can further include one or more flavoring components commonly used in the coffee industry (e.g., hazelnut and French vanilla, as exemplified herein). Combinations of beans and/or nuts and/or sticks (e.g., cinnamon sticks) can be mixed together with the smokeless tobacco to provide new and distinct flavors.

The invention will be further described in the following examples, which do not limit the scope of the invention described in the claims.

EXAMPLES

Example 1

French Roast-Flavored Smokeless Tobacco

A method for the production of a coffee flavored smokeless tobacco product was performed using smokeless tobacco and French roast Arabica beans.

Tobacco leaves were selected that had a moisture content of 24-26%. The tobacco leaves were processed through a cutter into strips. The moisture content was increased to approximately 60% by the addition of water and the pH was raised to 7.9. The final salt concentration was approximately 7.5%.

About 3% (by weight) whole French roast coffee beans were combined with processed tobacco and stored at room temperature for up to two weeks. Smokeless tobacco samples were found to have distinct flavor characteristics of French roast coffee upon chewing after 2 days of storage, and the flavor increased in intensity with longer storage times.

Example 2

Hazelnut-Flavored Smokeless Tobacco

A method for the production of a hazelnut flavored smokeless tobacco product was performed using smokeless tobacco and hazelnut flavored Arabica beans.

Tobacco leaves were selected that had a moisture content of 24-26%. The tobacco leaves were processed through a cutter into strips. The moisture content was further increased to approximately 60% by the addition of water, and the pH was raised to 7.9. The final salt concentration was approximately 7.5% salt.

About 3% (by weight) whole hazelnut coffee beans were combined with processed tobacco and stored at room temperature for up to two weeks. Smokeless tobacco samples were found to have distinct flavor characteristics of hazelnut coffee upon chewing after 2 days of storage, and the flavor increased in intensity with longer storage times.

Example 3

French Vanilla-Flavored Smokeless Tobacco

A method for the production of a French vanilla flavored smokeless tobacco product was performed using smokeless tobacco and French vanilla Arabica beans.

Tobacco leaves were selected that had a moisture content of 24-26%. The tobacco leaves were processed through a cutter into strips. The moisture content was further increased to approximately 60% by the addition of water, and the pH was raised to 7.9. The final salt concentration was approximately 7.5% salt.

About 3% (by weight) whole French vanilla coffee beans were combined with processed tobacco and stored at room temperature for up to two weeks. Smokeless tobacco samples were found to have distinct flavor characteristics of French vanilla coffee upon chewing after 2 days of storage, and the flavor increased in intensity with longer storage times.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method for the production of a smokeless tobacco product, comprising:

providing smokeless tobacco;

combining said smokeless tobacco with one or more solid flavor agents to form said flavored smokeless tobacco composition having a flavor characteristic of said one or more solid flavor agents, wherein said one or more solid flavor agents are whole beans, whole nuts, and/or whole sticks; and removing said one or more solid flavor agents from said smokeless tobacco after said flavored smokeless tobacco composition having a flavor characteristic of said one or more solid flavor agents is formed so that said one or more solid flavor agents do not remain in the final smokeless tobacco product.

2. The method of claim 1, wherein said solid flavor agents comprise about 1% to about 30% by weight.

3. The method of claim 1, wherein said whole beans are selected from the group consisting of whole coffee beans, whole vanilla beans, or whole cocoa nibs.

4. The method of claim 3, wherein said whole coffee beans are selected from the group consisting of Arabica, Brazillian Santos, Colombian Supremo, Costa Rican, Ethiopian Harrar, Hawaiian Kona, Kenya AA, Jamaica, Sumatra, Tanzanian Peaberry, and Zimbabwe whole coffee beans.

5. The method of claim 1, wherein said whole nuts are selected from the group consisting of whole almonds, whole peanuts, whole cashews, whole walnuts, whole pecans, whole hazelnuts, and whole pistachios.

6. The method of claim 1, wherein said whole sticks are whole cinnamon sticks.

7. The method of claim 1, further comprising adjusting the moisture content of said tobacco to be from about 25% to about 55%.

8. The method of claim 1, further comprising adjusting the salt concentration of said tobacco to between about 1% and about 10%.

9. The method of claim 1, wherein said flavored smokeless tobacco is moist snuff or chewing tobacco.

10. The method of claim 1, wherein said tobacco is selected from the group consisting of air cured, burley, dark, dark-fired, and flue cured.

11. The method of claim 1, wherein said tobacco is fermented.

12. The method of claim 1, wherein said tobacco is dark-fired tobacco.

13. The method of claim 1, wherein said one or more solid flavor agents are whole coffee beans.

14. The method of claim 1, wherein said combining step comprises combining said tobacco with said one or more solid flavor agents for up to two weeks.

15. A method of producing a smokeless tobacco product, comprising:

combining smokeless tobacco with one or more solid flavor agents to form a flavored smokeless tobacco having a flavor characteristic of said one or more solid flavor agents, wherein said one or more solid flavor agents comprise whole beans, whole nuts, and/or whole sticks; and separating said one or more solid flavor agents from said flavored smokeless tobacco having a flavor characteristic of said one or more solid flavor agents and making a smokeless tobacco product comprising said flavored smokeless tobacco having a flavor characteristic of said one or more solid flavor agents.

16. The method of claim 15, wherein said one or more solid flavor agents comprise about 1% to about 30% by weight.

17. The method of claim 15, wherein said whole beans are selected from the group consisting of whole coffee beans, whole vanilla beans, or whole cocoa nibs.

18. The method of claim 17, wherein said whole coffee beans are selected from the group consisting of Arabica, Brazillian Santos, Colombian Supremo, Costa Rican, Ethiopian Harrar, Hawaiian Kona, Kenya AA, Jamaica, Sumatra, Tanzanian Peaberry, and Zimbabwe whole coffee beans.

19. The method of claim 15, wherein said flavored smokeless tobacco is moist snuff or chewing tobacco.

20. The method of claim 15, wherein said tobacco is selected from the group consisting of air cured, burley, dark, dark-fired, and flue cured.

21. The method of claim 15, wherein said tobacco is dark-fired tobacco.

22. The method of claim 15, wherein said one or more solid flavor agents are whole coffee beans.

23. The method of claim 15, wherein said combining step comprises combining said tobacco with said one or more solid flavor agents for up to two weeks.

24. The method of claim 15, wherein said whole nuts are selected from the group consisting of whole almonds, whole peanuts, whole cashews, whole walnuts, whole pecans, whole hazelnuts, and whole pistachios.

25. The method of claim 15, wherein said whole sticks are whole cinnamon sticks.

26. The method of claim 15, further comprising adjusting the moisture content of said tobacco to be from about 25% to about 55%.

27. The method of claim 15, further comprising adjusting the salt concentration of said tobacco to between about 1% and about 10%.

28. The method of claim 15, wherein said tobacco is fermented.

* * * * *

UNITED STATES PATENT AND TRADEMARK OFFICE

CERTIFICATE OF CORRECTION

PATENT NO. : 7,901,512 B2
APPLICATION NO. : 10/979266
DATED : March 8, 2011
INVENTOR(S) : Phillip F. Quinter It is certified that error appears in the above-identified patent and that said Letters Patent is hereby corrected as shown below:

In claim 4, column 5, line 41, delete “Brazillian” and insert -- Brazilian --, therefor.

In claim 15, column 6, line 17, delete “and”.

In claim 15, column 6, line 20, delete “agents” and insert -- agents; --, therefor.

In claim 18, column 6, line 31, delete “Brazillian” and insert -- Brazilian --, therefor.

Signed and Sealed this
Thirty-first Day of May, 2011

David J. Kappos

David J. Kappos
*Director of the United States Patent and Trademark Office*